US008739718B2

(12) United States Patent
Gros

(10) Patent No.: US 8,739,718 B2
(45) Date of Patent: Jun. 3, 2014

(54) BOAT DOOR AND METHOD OF MAKING

(76) Inventor: Charles Preston Gros, Eagle Point, OR (US)

( * ) Notice: Subject to any disclaimer, the term of this patent is extended or adjusted under 35 U.S.C. 154(b) by 29 days.

(21) Appl. No.: 13/437,926

(22) Filed: Apr. 2, 2012

(65) Prior Publication Data

US 2012/0285357 A1 Nov. 15, 2012

Related U.S. Application Data

(63) Continuation-in-part of application No. 12/348,271, filed on Jan. 2, 2009, now Pat. No. 8,146,526.

(51) Int. Cl.
*B63B 3/00* (2006.01)

(52) U.S. Cl.
USPC ..... 114/65 R; 114/117

(58) Field of Classification Search
USPC ..... 114/117, 65 R
See application file for complete search history.

(56) References Cited

U.S. PATENT DOCUMENTS

| | | | | | |
|---|---|---|---|---|---|
| 2,103,291 | A * | 12/1937 | Lambert et al. | ..... | 114/117 |
| 2,797,884 | A * | 7/1957 | Peed, Jr. | ..... | 244/129.5 |
| 2,844,118 | A * | 7/1958 | Kummerman | ..... | 114/202 |
| 4,833,829 | A | 5/1989 | Wilson | | |
| 5,718,088 | A * | 2/1998 | Jacobsen | ..... | 52/200 |
| 8,146,526 | B2 * | 4/2012 | Gros | ..... | 114/201 R |
| 2007/0295257 | A1 | 12/2007 | Martin | | |
| 2011/0047771 | A1 * | 3/2011 | Smith | ..... | 29/401.1 |

* cited by examiner

*Primary Examiner* — Stephen Avila
(74) *Attorney, Agent, or Firm* — Robert J. SayFie

(57) ABSTRACT

A boat hull having a door and a method of making the door, which can swing to an open position and closed position. The door can be used for entering or exiting the boat. The door can remain closed with a door lock assembly and door strike. An outer door frame and gussets provide support for the hull and door.

3 Claims, 3 Drawing Sheets

BOAT DOOR AND METHOD OF MAKING

RELATED APPLICATIONS

This is a continuation in part patent application, which claims priority on U.S. patent application Ser. No. 12/348,271, filed on Jan. 2, 2009 now U.S. Pat. No. 8,146,526.

GOVERNMENT RIGHTS

This invention was not made with Government support under. The Government does not have any rights in this invention.

BACKGROUND OF THE INVENTION

This invention relates to a boat door and a method of making the door. This invention relates to doors for watercraft, including drift or dory boats.

U.S. Patent Application Publication number 2007/0295257 discloses a boat having an outside pocket door, which slides in the housing for entry and egress.

U.S. Pat. No. 4,833,829 discloses a sliding door for closure of entranceways and to companionway entrance closure for watercraft.

There is a need for an entry and egress door on fishing boats. There is need for an entry and egress door on drift or dory boats.

The present invention door or doors make it easier for a passenger to enter or exit the boat. Without a door the passenger would have to lift their leg over the gunwale or side of the boat causing a potentially dangerous falling situation by putting passenger off balance if they catch their shoe or boot or foot. Older people, children, or people with disabilities particularly have problems climbing in and out of boats. Having a door cuts the distance to climb into the boat, making it similar to getting into a vehicle with a door.

The door also makes it easier to get into the boat while boat is on a trailer. Present designs force the person wanting to get in the boat to climb over the gunwale or side of the boat creating a potentially dangerous situation. The door makes this simpler by dropping the distance it takes to maneuver the side or gunwale of the boat.

The main usage of a drift or a dory boat is for different types of fishing. Passengers may be wearing hip waders for fly fishing, or boots to keep warm and dry in winter seasons. Having to maneuver in and out of the boat while wearing this type of gear is made easier with a door.

In addition, the present invention includes a method of making the door.

The door or doors of the present invention are located above the water line to allow the door to be opened while traveling if the water conditions are favorable.

SUMMARY OF THE INVENTION

One aspect of the present invention is A boat hull (10), comprising: a hinge (20) hingedly secured to a rear edge (70) of a boat door (15); a first lower edge (75) extending downwardly from the rear edge (70); a second lower edge (77) extending upwardly from said first lower edge (75) to a front edge (80); a door lock assembly (50) lockingly engaged with a door strike (30) an outer door frame ( ) extending inwardly from the boat hull (10); a first door gusset (55) immediately adjacent to said door frame near the rear edge (70); a hull gusset (90) immediately adjacent to the door frame near the second lower edge (77).

Another aspect is a method of making a boat door (300), comprising the steps of: using weld penetration lines as a reference and layout the door frames on the outside of the hull (310); cutting an inner door frame loose from the hull (320); cleaning excess material away from edges of said inner door frame and an outer door frame and welding said edges (330); grinding an exterior weld smooth (340); installing a hinge on said outer door frame (350); fitting said boat door and mounting said hinge to said inner door frame (360); and installing a lock and a lock strike (350).

REFERENCE NUMERALS

10 boat hull
15 door
17 door inside surface
19 door outside surface
20 hinge
30 door strike
40 seal
50 door lock assembly
55 first door gusset
60 inner door frame
70 second door gusset
75 first lower edge
77 second lower edge
90 hull gusset
300 method of making a boat door
310 using weld penetration lines as a reference, laying out a door frame on an outside of a hull;
320 cutting an inner door frame loose from the hull
330 cleaning excess material away from edges of the inner door frame and welding frame edges
340 grinding all exterior welds smooth
350 installing a hinge on an outer door frame
360 fitting a door in a desired location and mounting the hinge to the inner door frame
370 disassembling the door
380 painting the door
390 reassembling the door
400 adding gasket to the door at desired locations
410 preassembling and welding the inner door frame to the outer door frame
420 welding the preassembled inner door frame and outer door frame to the hull
430 adding door hull gussets

DETAILED DESCRIPTION OF THE INVENTION

The following detailed description is of the best currently contemplated modes of carrying out the invention. The description is not to be taken in a limiting sense, but is made merely for illustrating the general principles of the invention, since the scope of the invention is best defined by the appended claims.

Broadly, the present invention is a door 15 for boats. More particularly, it is a door 15 for drift or dory boats. The present invention also includes the method of making the boat door (300).

Figure 1:
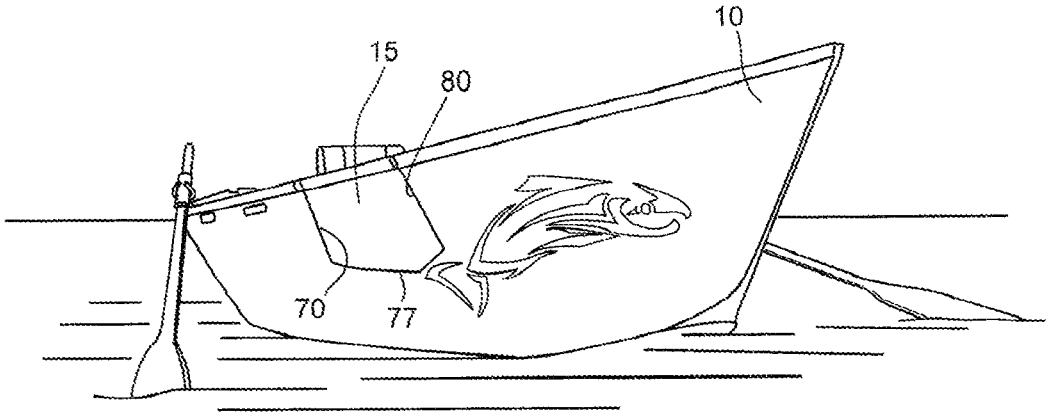
FIG. 1 is a pictorial of an embodiment of the present invention.

FIG. 1 is a pictorial of an embodiment of the present invention 15. The door 15 may be hingedly connected to the boat hull 10 via a hinge 20. In one embodiment, the door 15 may be hingedly connected to the boat hull 10 via a hinge 20 on a rear edge 70 of the door 15. In this embodiment the door 15 would open similar to suicide doors of an automobile. FIG. 1 also illustrated that there is an angle between the first lower edge 75 and a second lower edge 77, and that that the inside angle between the first lower edge 75 and the second lower edge 77 is between 90 degrees and 180 degrees, and in one embodiment, it may be about 120 degrees.

Figure 5:
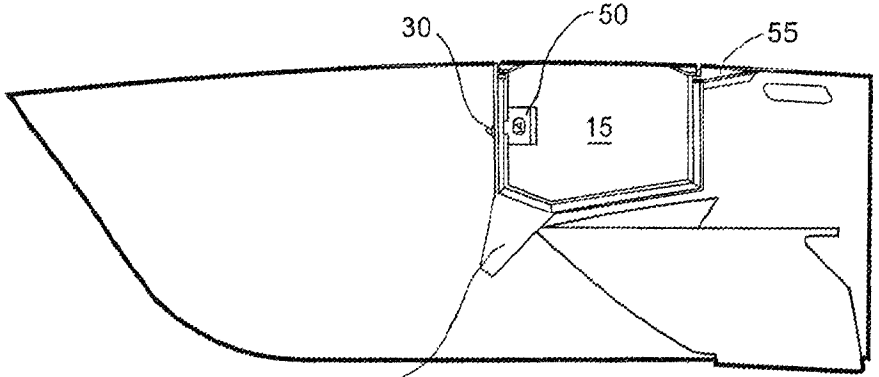
FIG. 5 is a pictorial of an embodiment of the present invention.

The door 15 may remain closed by the use of a door lock assembly 50 capable of locking in the closed position when the lock assembly contacts the door strike 30, as seen in FIG. 5.

The door strike 30 may be disposed to a second door gusset 70.

Figure 2:
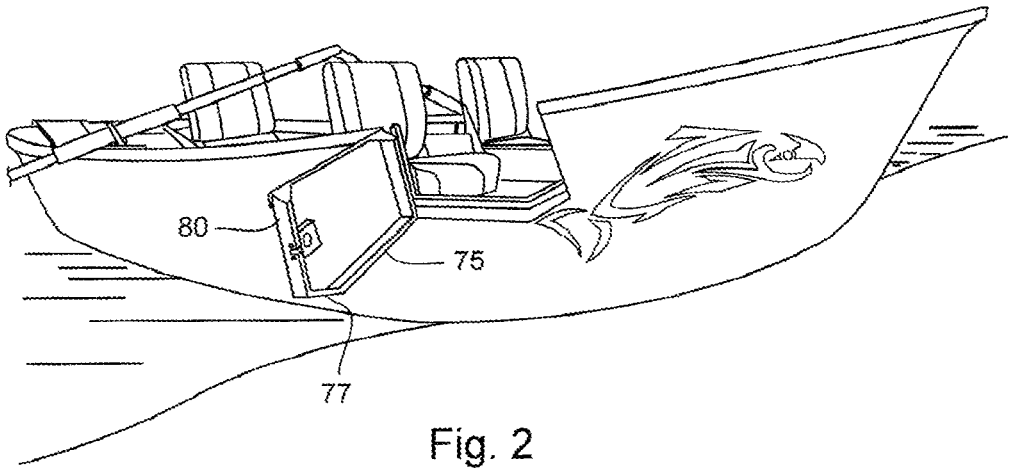
FIG. 2 is a pictorial of an embodiment of the present invention.

FIG. 2 illustrates the present invention 10 with the boat door 15 open.

Figure 3:
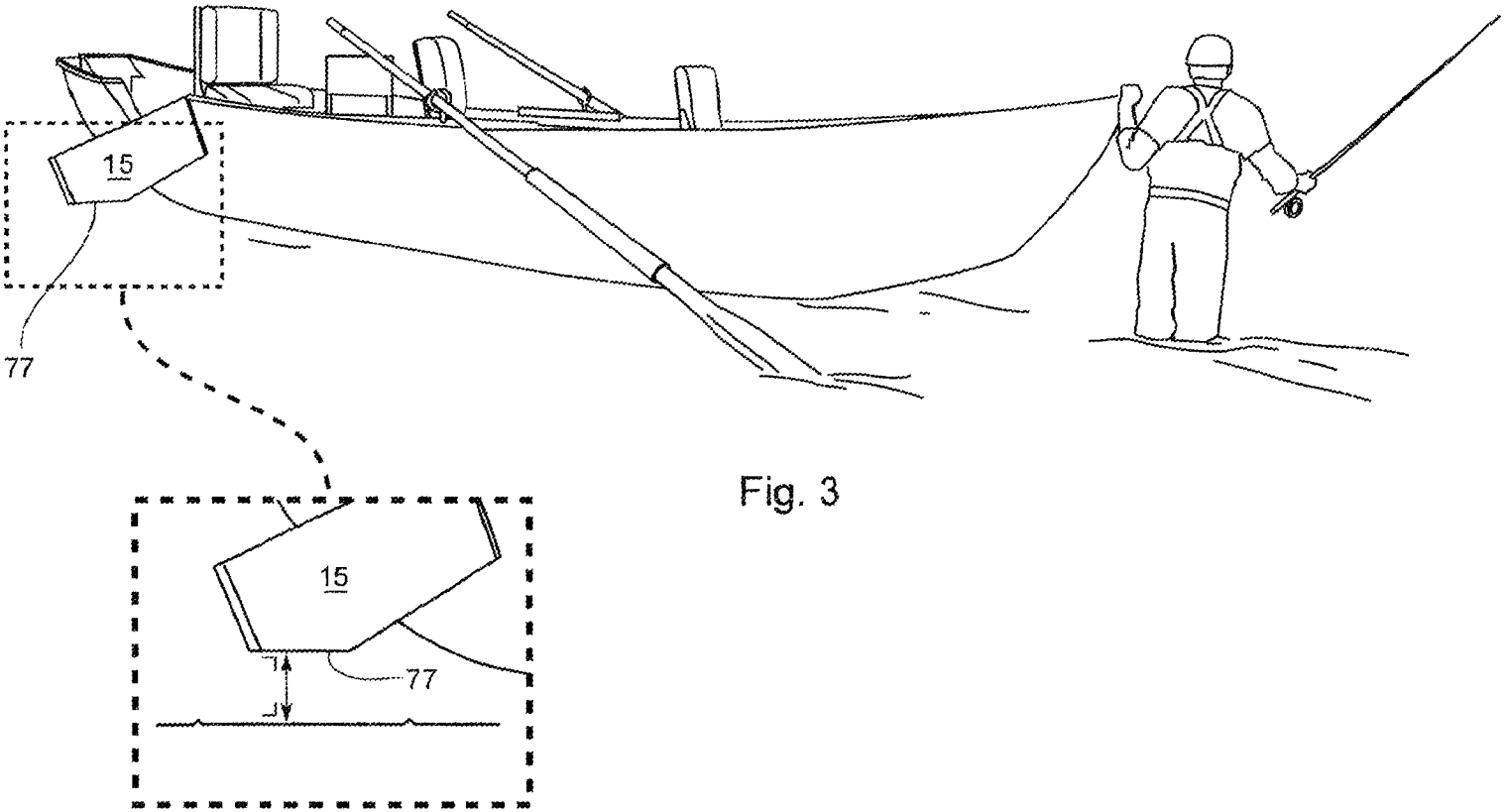
FIG. 3 is a pictorial of an embodiment of the present invention.

FIG. 3 illustrates the present invention 10 with the boat door 15 open, and illustrates how the second lower edge 77 may be about parallel with the ground or water surface when opened. This being due to the shape of the hull and the angle between the first lower edge 75 and the second lower edge 77.

Figure 4:
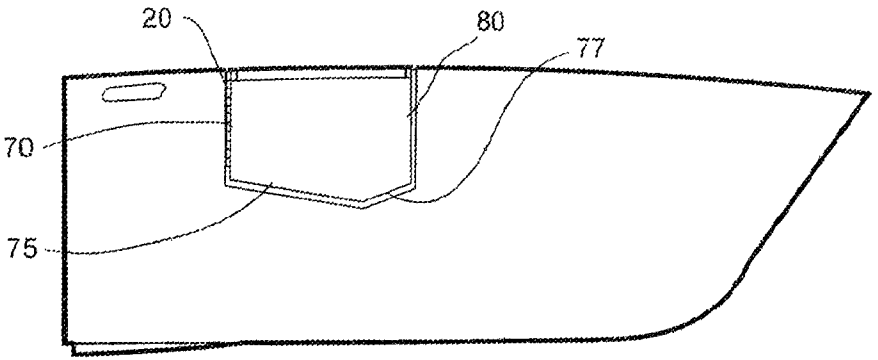
FIG. 4 is a pictorial of an embodiment of the present invention.

FIG. 4 illustrates the door hinge 20 being hingedly disposed to the rear edge 70 of the door.

FIG. 5 illustrates one embodiment of the door 15 and the door lock assembly 50 that may lockingly engage with the door strike 30.

Figure 6:
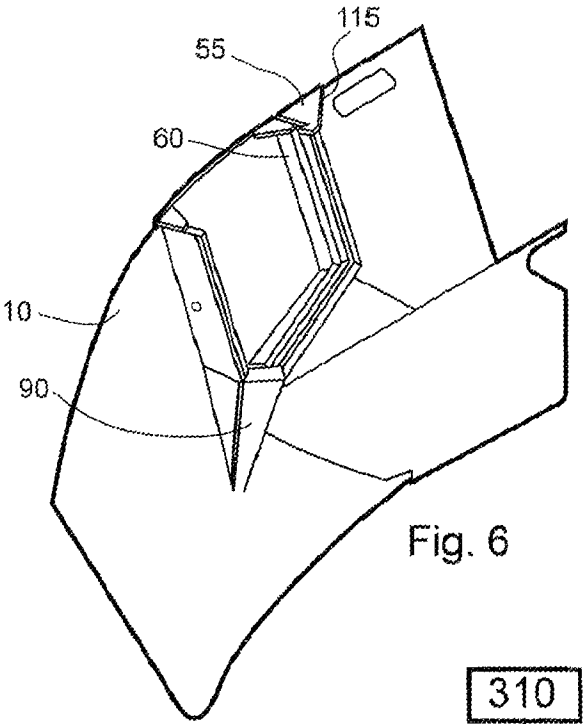
FIG. 6 is a pictorial of an embodiment of the present invention.

FIG. 6 illustrates how a hull gusset 90 may be disposed on the inside of the hull to support the door 15 and second door gusset 70. The second door gusset 70 may extend inwardly from the hull to the inside of the boat. A first door gusset 55 may extend from the inner door frame 60 to an inside surface 115 of the hull.

The inner door frame 60 may extend inwardly. The inner door frame 60 may provide additional support for the door 15.

Figure 7:
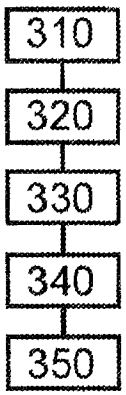
FIG. 7 is a schematic of an embodiment of a method of the present invention.

FIG. 7 illustrates an embodiment of a schematic of a present invention of making 300 a boat door.

It should be understood, of course, that the foregoing relates to exemplary embodiments of the invention and that modifications may be made without departing from the spirit and scope of the invention as set forth in the following claims.

I claim:

1. A boat hull (10), comprising:

a hinge (20) hingedly secured to a rear edge (70) of a boat door (15);

a first lower edge (75) extending downwardly from the rear edge (70);

a second lower edge (77) extending upwardly from said first lower edge (75) to a front edge (80);

a door lock assembly (50) lockingly engaged with a door strike (30);

an inner door frame (60) extending inwardly from the boat hull (10);

a first door gusset (55) immediately adjacent to said inner door frame (60) near the rear edge (70); and a hull gusset (90) immediately adjacent to the inner door frame (60) near the second lower edge (77).

2. The apparatus of claim 1, further comprising:

the inner door frame (60) extending inwardly from the door (15).

3. A method of making a boat door (300), comprising the steps of:

using weld penetration lines as a reference and layout the door frames on the outside of the hull (310);

cutting an inner door frame loose from the hull (320);

clearing excess material away from edges of said inner door frame and an outer door frame and welding said edges (330);

grinding an exterior weld smooth (340);

installing a hinge on said outer door frame (350);

fitting said boat door and mounting said hinge to said inner door frame (360);

preassembling and welding said inner door frame and said outer door frame (410);

welding said preassembled inner door frame and said outer door frame to the hull (420); and adding door and hull gussets (430).

* * * * *